United States Patent [19]

Angelo

[11] 4,270,423

[45] Jun. 2, 1981

[54] SLAB TRIMMING APPARATUS

[76] Inventor: Frank M. Angelo, Box 847, Jonesboro, Ark. 72401

[21] Appl. No.: 43,379

[22] Filed: May 29, 1979

[51] Int. Cl.[3] ..... B27B 7/02; B27B 1/00

[52] U.S. Cl. ..... 83/102.1; 83/404.1; 83/425.1; 83/425.2; 144/312

[58] Field of Search ..... 144/312, 251 R; 83/404.1, 420, 425.1, 425.2, 435.2, 102.1

[56] References Cited

U.S. PATENT DOCUMENTS

| | | | |
|---|---|---|---|
| 3,452,793 | 7/1969 | Wexell | 144/312 |
| 3,542,098 | 11/1970 | Hill | 144/251 R X |
| 3,650,307 | 3/1972 | Johnson | 144/3 R |
| 3,771,397 | 11/1973 | Smith | 83/404.1 X |
| 4,146,072 | 3/1979 | Detjen | 144/312 |

FOREIGN PATENT DOCUMENTS

| | | | |
|---|---|---|---|
| 247558 | 10/1963 | Australia | 144/312 |

*Primary Examiner*—Willie G. Abercrombie

*Attorney, Agent, or Firm*—Hill, Van Santen, Steadman, Chiara & Simpson

[57] ABSTRACT

A saw and a continuous process or method is provided for converting log trim pieces from four sides of each log from scrap into usable flat sided lumber pieces. Log trim pieces are deposited onto a conveyor in longitudinally spaced relation and fed into a first pair of rotary saw blades for trim cutting opposite side edges of the log trim piece. As the thus trimmed log trim piece is transported further on the conveyor, a second generally horizontally positioned rotary saw is operated to trim cut an upper surface area of the log trim piece to form a flat board side which is in parallel relation to a flat bottom side of the trim place. The saw and process is continuously operated so that subsequently received trim pieces can be similarly cut and/or processed as previously described to provide usable flat-sided lumber pieces from scrap material.

2 Claims, 6 Drawing Figures

SLAB TRIMMING APPARATUS

BACKGROUND OF THE INVENTION

1. Field of the Invention

The field of the invention pertains to saws and a continuous process for converting log trim pieces from four sides of each log from scrap into usable flat-sides lumber pieces.

2. The Prior Art

In the past, a variety of different saws have been used for the purpose of trim cutting lumber. Such saws and processes have not been particularly suited for converting scrap from four sides of each log which has been here identified as log trim pieces into usable flat sided lumber pieces. Previously, scrap or log trim pieces of the type here converted into a useful product have been for the most part, treated as a waste product, and disposed of at a less expensive price to users for such product.

BRIEF SUMMARY OF THE INVENTION

The saw of the present invention includes a conveyor for transporting log trim pieces into a first pair of vertically extending saw blades positioned at opposite sides of the conveyor for trimming opposite edges of each log trim piece from material that has been previously disposed of as scrap. According to the present invention, a saw has thus been provided which enables scrap materials to be converted into flat-sided lumber pieces, in a relatively high speed economical procedure.

The saw of the present invention is further provided with hold down means for engagement against upper surface areas of the log trim pieces so that the log trim piece can be maintained in a proper aligned position during the cutting operations performed thereupon.

The saw of the present invention is further provided with guide means for controlling scrap cut from the converted log trim pieces so that the newly cut scrap can be directed onto a scrap belt for transportation to an area remote to the saw for further handling.

The present invention further concerns a continuous process of converting log trim pieces from sides of a log from scrap into usable flat-sided lumber pieces. This method can be accomplished by placing flat-sided log trim pieces in longitudinally spaced relation each with its flat side engaged top side of a longitudinally moving conveyor, the log trim pieces are then side-cut and top-cut with the cuts being oriented in right angled relationship to one another to thereby form flat-sided or parallel sided lumber pieces in a continuous operation.

As a further part of my invention, a new and improved method of cutting logs is herein disclosed whereby the trim pieces are continuously converted into flat-sided lumber pieces.

DETAILED DESCRIPTION OF THE PREFERRED EMBODIMENT

Figures 1, 3:
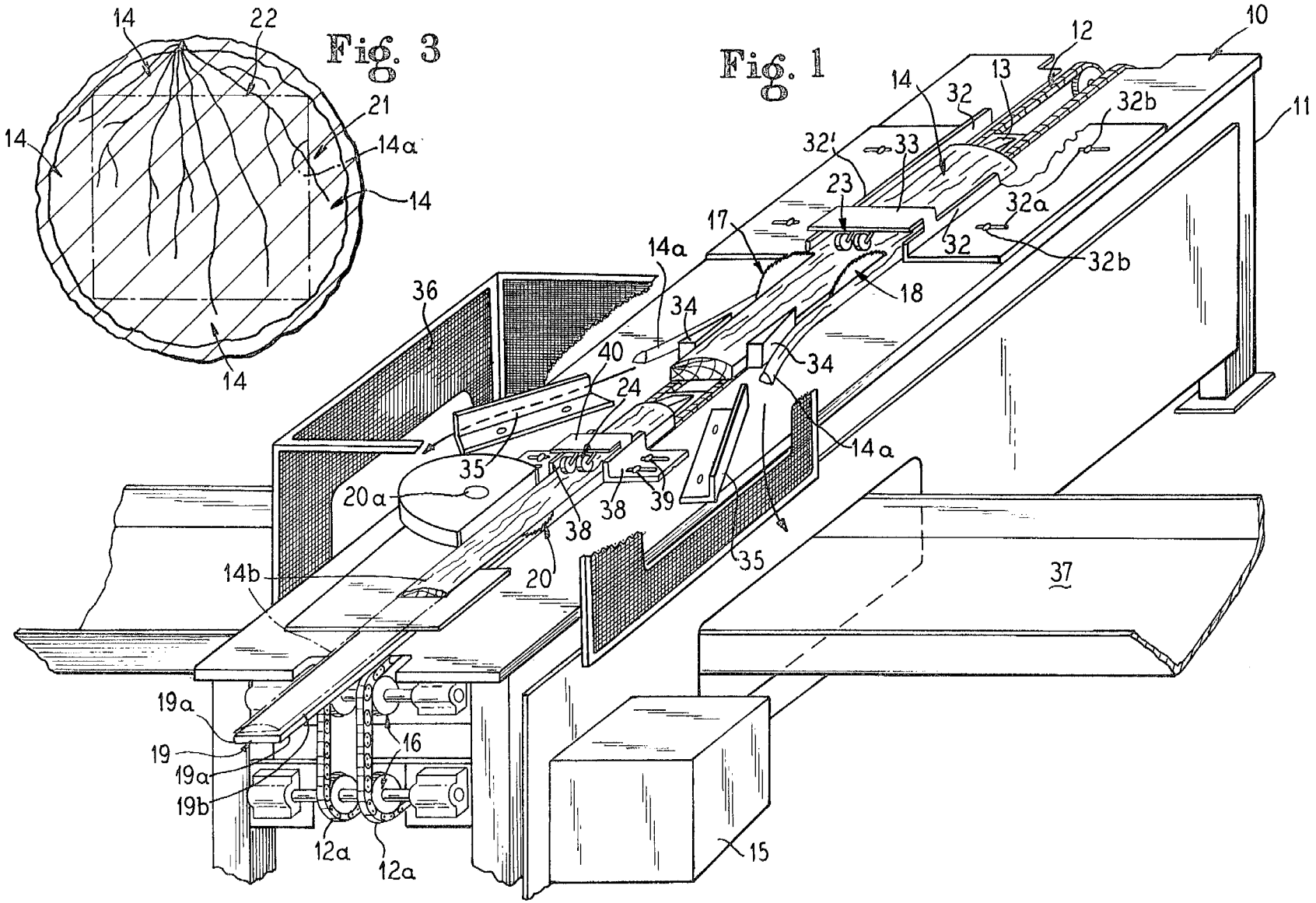
FIG. 1 is an enlarged fragmentary schematic view of a saw also illustrating a continuous process of converting log trim pieces from scrap into flat-sided lumber pieces, according to the principles of the present invention.
FIG. 3 is a diagrammatic end view of a log illustrating the way in which log trim pieces are normally cut from a log to form a board.

A flat bed type saw 10 is illustrated in FIG. 1. The saw includes a frame 11 which can be of any suitable type. Mounted top-side of the frame 11 is an endless feed conveyor 12. The feed conveyor 12 is of a chain type and has longitudinally spaced dogs 13 for carrying log trim pieces 14 therein. The log trim pieces are adapted to be manually placed upon the conveyor by the machine or saw operator. A drive mechanism 15 is provided for driving the conveyor 12 through a drive gear (not shown) in a conventional manner. Provided at opposite ends of the frame 11 are sets of gears 16, 16, which coact with endless conveyor chains **12*a*, 12*a*,** also in a conventional manner.

Figure 4:
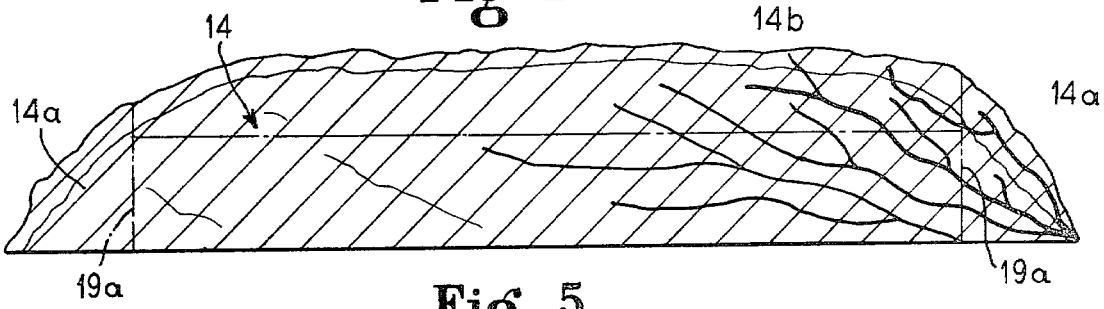
FIG. 4 is an enlarged vertical section in full and dotted lines with the dotted lines showing the way in which a log trim piece can be cut to form a usable flat-sided lumber piece.
Figure 5:
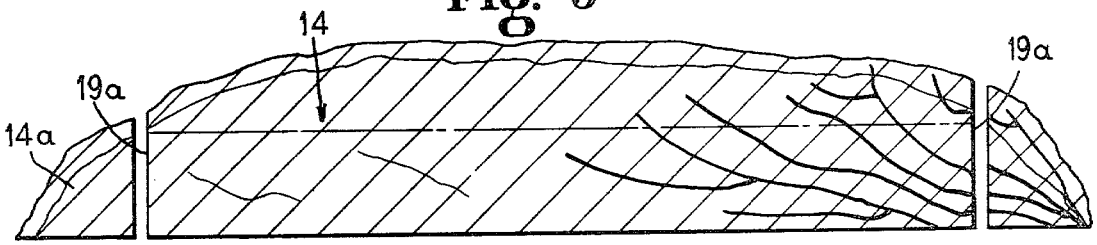
FIG. 5 is an exploded vertical section showing the way in which a log trim piece can be sawed to produce flat sides at opposite edges.
Figure 6:
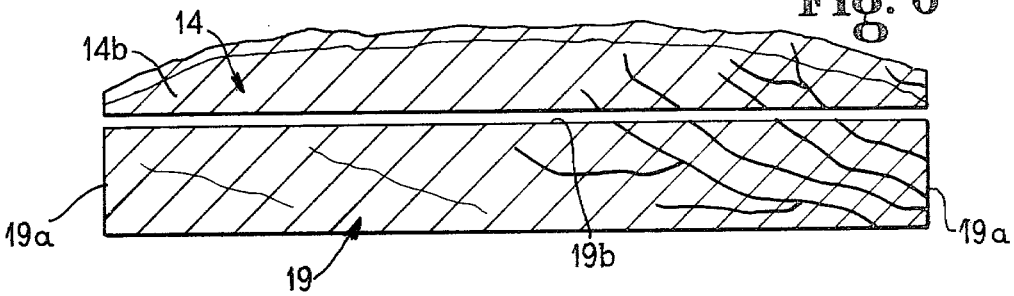
FIG. 6 is an exploded vertical section similar to FIG. 5 only showing the way in which the log trim piece can be further sawed along its upper area to produce a usable flat side or parallel sided lumber piece.

The saw 10 is further provided with a pair of coaxially mounted upright saw blades 17 and 18. These saw blades are positioned on opposite sides of the endless feed conveyor 12 and can be adjustably positioned in any suitable manner so that opposite edges of each log trim piece 14 can be suitably cut to form a suitably sized flat-sided or parallel sided lumber piece, as is illustrated in FIG. 6. From a consideration of FIGS. 3–6, it will be seen how a log 21 can be cut in a conventional manner to produce the log trim pieces 14, 14, 14, 14 at the four sides of the board 22. From a consideration of FIG. 4, it will be seen how opposite edges of the log trim piece 14 can be trimmed to produce parallel flat-sided edges **19*a*, 19*a*, which operation is carried out by the cutting action of the saw blades 17 and 18 as shown in FIG. 1**.

The saw 10 is also provided with a rotary driven saw 20, which is mounted on its vertical axis **20*a* on the frame for horizontally cutting the log trim piece 14 and producing a flat side 19*b* topside of each log trim piece to convert the pieces 14 into usable flat-sided lumber pieces 19. The saws 17, 18 and 20 are all suitably mounted upon the frame 11** and can be suitably driven and controlled in a conventional manner.

Figure 2:
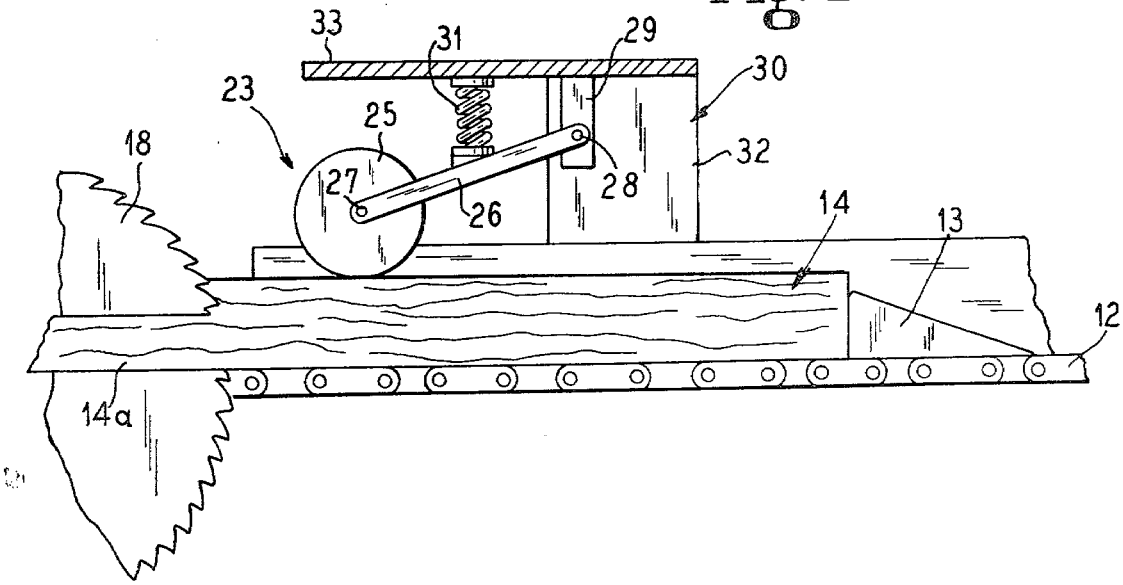
FIG. 2 is an enlarged fragmentary partially sectioned detailed view illustrating a hold-down device and its relationship with respect to the conveyor and other components.

In order to facilitate the cutting operation, the saw 10 is provided with a pair of spring loaded mechanical hold-down devices indicated generally at 23 and 24. These hold-down devices are identical in construction and operation, and a description of one will suffice for both. Illustrated in FIG. 2 is the hold-down device 23. The hold-down device 23 includes a pair of rollers 25 mounted upon suppport arms 26, which support arms are pivotally connected at 27 to the roller 25 and at 28 to a support bracket 29. The brackets 29 are mounted upon roller suspension frame 30 which is anchored to the frame on opposite sides of the endless feed conveyor 12, as is illustrated in FIG. 1. The hold-down mechanisms 23 and 24 are operated in such a way that the rollers 25 engage the rounded upper surfaces of each log trim piece 14, as the log trim piece is carried through the sawing operation by the lugs 13 on the endless conveyor 12. Springs 31 are suspended from the roller suspension frame 30, and engage against the roller arm 26 to forcibly urge the roller 25 against the log trim piece 14 to ensure that the log trim piece will be firmly held against the conveyor during the sawing operation, whether saw blades 17 and 18 are being operated or saw blade 20 is being operated in the cutting operation of the log trim piece.

The saw 10 is provided with a series of guides for assisting in the sawing operation. To this end, log trim guides 32, 32 are mounted on opposite sides of the endless feed conveyor and are adjustably attachable to the frame by the fasteners 32*a*, 32*a* which are engaged through the elongated plate slots 32*b*, 32*b* so that the plates 32 can be moved toward and away from one another to accommodate for different widths of log trim pieces 14. Fixedly mounted topside of one of the log trim guides 32 is an elevated plate 33 which acts as a support for the hold-down device 23. One end of the elevated plate 33 is slidably orientated with respect to guide edge 32' so that as the log trim guides are moved toward and away from one another, the plate 33 can be adjustably positioned because of its fixed attachment to one of the log trim guides 32 and its sliding engagement with the other one.

As the saws 17 and 18 operate to cut the log trim piece 14 and to trim off the log trim scrap segments 14*a*, 14*a*, guides 34—34 are provided to cause the segments to move away from the conveyor 12 so as not to interfere with the second cutting operation that is yet to be done on the log trim piece 14. A second set of guides 35, 35 coacts with the first set of wedge shaped scrap guides 34, 34 for conveying the trim segments 14*a*, 14*a* off of the upper surface of the frame 11 and into a screen protector bin 36 and into a trim receptacle 37.

Downstream in adjacency of the second hold-down device 24, a second pair of guides 38, 38 are positioned for assisting in the further cutting operation carried out by the saw blade 20. To this end, the guides 38, 38 are similarly attached to the frame 11 by means of the fasteners 39 and are provided with a plate 40 which is fixedly attached to one of the guides 39 and is slidably attached with respect to the other of the guides and operable in the same manner as previously discussed in connection with the guides 32—32. The plate 40 serves to support the hold-down device 24 in position with respect to the log trim piece so that the log trim piece cannot move out of its path of movement relative to the conveyor during the second cutting operation to be performed by the saw 20. It will be further understood from a consideration of the drawings, that after the saw 20 has completed its cutting operation, that the flat-sided lumber pieces will be allowed to fall free of the topside of the frame into a bin (not shown) along with upper scrap segments such as are illustrated by the numeral 14*b*.

In view of the foregoing, it will therefore be understood that a new method of cutting logs has been provided. Initially, the log 21 (FIG. 3) is provided with four longitudinal cuts, thus producing four trim pieces 14 and the log 21. Thereafter, the trim pieces 14 are supported on flat bottom sides and caused to move longitudinally in a continuous longitudinal direction while resting on their flat sides. First the trim pieces are each then first cut on opposite longitudinal edges by saw blades 17 and 18 to form each piece with parallel longitudinal sides 19*a*—19*a* as seen in FIG. 1. The trim pieces are then moved further in a continuous longitudinal direction and subjected to a second cutting operation whereby the saw blade 20 cuts and forms an upper side 19*b* which is parallel to the bottom side of the log trim piece 14 as shown for purposes of illustration at 14*a* in FIG. 3.

It will be apparent to those skilled in the art that many modifications and variations may be effected without departing from the spirit and scope of the novel concepts of the present invention.

I claim as my invention:

1. A slab trimming apparatus adapted to square up slabs cut from outer sections of logs, each slab has a curved surface bounded by a straight surface, said apparatus comprising:

an elongated supporting frame with a flat top surface and a conveyor adapted to move a plurality of slabs, with straight surfaces positioned adjacent said conveyor, along said elongated dimension of said frame, the members of the plurality of slabs are spaced apart from one another by spaced apart, wedge shaped, pushing members affixed to said conveyor, each said pushing member pushes an associated slab through said elongated dimension of said frame, first and second powered rotary saws selectively positioned near a first end of said frame, said saws rotate in planes perpendicular to said flat top surface and are spaced apart laterally from one another on a common axis of rotation with said conveyor therebetween, said lateral spacing determines a width dimension of the squared up slabs which are pushed by said conveyor through said saws, first and second elongated wedge shaped trim deflecting members affixed to said flat top surface adjacent output sides of said first and second saws with said conveyor passing therebetween, said first and second wedge shaped members are adapted to laterally deflect pieces trimmed from each slab by said first and second saws, first and second elongated right-angle members affixed to said flat top surface a selected distance away from said first and second trim directing members and oriented laterally outwardly with respect thereto, said first and second right angle members are adapted to further deflect laterally and off of said frame the pieces trimmed from each side of each slab, a third circular, rotary, powered saw positioned near a second end of said frame with an axis of rotation perpendicular to said flat top surface, said third saw is spaced vertically above said top surface, over a section of said conveyor, a selected distance corresponding to a desired height dimension of the squared up slabs, said pushers push each slab past said third saw thereby trimming a top portion from each slab producing a board with a rectangular cross section, an elongated planar deflection member located on an output side of said third saw and adapted to deflect the trimmed top portion from each squared up slab.

2. The apparatus according to claim 1, including further:

first and second U-shaped guide members each with a central region positioned above said conveyor, parallel to said top surface, such that the slabs are pushed therebetween, said first guide member is affixed to said top surface adjacent input sides of said first and second saws and has two adjustably spaced apart members, oriented perpendicular to said top surface and adapted to be positioned in sliding contact with outer elongated edges of each slab thereby determining the lateral position of each slab with respect to said first and second saws, said second guide member is affixed to said top surface, adjacent an input side of said third saw and has two adjustably spaced apart members, oriented perpendicular to said top surface and adapted to be positioned in sliding contact with first and second parallel, spaced apart side surfaces of each slab formed by said first and second saws thereby determining the lateral position of each slab with respect to said third saw, first and second rotatable, spring biased, cylindrical hold-down means affixed to a respective central part of said first and second U-shaped guide members and adapted to rotatably engage a curved top surface of a first and a second slab being cut respectively by said first and second saws, and by said third saw, and to force the respective slabs toward said frame.

* * * * *